United States Patent [19]

Ohwada et al.

[11] Patent Number: 4,736,137

[45] Date of Patent: Apr. 5, 1988

[54] MATRIX DISPLAY DEVICE

[75] Inventors: Jun-ichi Ohwada, Hitachi; Masaaki Kitajima, Hitachiota; Hideaki Kawakami, Mito, all of Japan

[73] Assignee: Hitachi, ltd, Tokyo, Japan

[21] Appl. No.: 77,504

[22] Filed: Jul. 24, 1987

[30] Foreign Application Priority Data

Aug. 1, 1986 [JP] Japan ..... 61-179971

[51] Int. Cl.[4] ..... G09G 3/10

[52] U.S. Cl. ..... 315/169.3; 340/781; 340/825.81

[58] Field of Search ..... 315/169.3; 340/781, 340/825.81

[56] References Cited

U.S. PATENT DOCUMENTS

| | | | |
|---|---|---|---|
| 3,343,128 | 9/1967 | Rogers | 340/825.81 |
| 4,042,854 | 8/1977 | Luo et al. | 340/781 |
| 4,112,333 | 9/1978 | Asars | 340/825.81 |
| 4,622,590 | 11/1986 | Togashi | 340/825.81 |

FOREIGN PATENT DOCUMENTS

| | | |
|---|---|---|
| 56-99396 | 1/1980 | Japan . |
| 57-201295 | 9/1982 | Japan . |

OTHER PUBLICATIONS

Liquid Crystal Matrix Display by Lechner et al, Proc. of IEEE Nov. 1971 vol. 59, No. 11 pp. 1566–1579.

*Primary Examiner*—Harold Dixon

*Attorney, Agent, or Firm*—Antonelli, Terry & Wands

[57] ABSTRACT

In a matrix display device, a signal drive circuit comprises selection means for sequentially selecting at least one of display information signals corresponding to a plurality of signal electrodes when at least one of a plurality of scan electrodes is selected, hold means for holding the display information signal selected by the selection means until selection of at least corresponding scan electrode is completed, and voltage conversion means for selecting one of a plurality of voltage levels in accordance with the display information signal held by the hold means and supplying the selected voltage level to the signal electrodes. Since the display information signal is held by the hold means until the selection of at least corresponding scan electrode is completed, one of the plurality of voltage levels is always applied to the signal electrodes and the switching elements do not assume the high impedance state. Accordingly, ununiformity in display image is prevented and a large size matrix display device is provided.

2 Claims, 5 Drawing Sheets

MATRIX DISPLAY DEVICE

BACKGROUND OF THE INVENTION

The present invention relates to a matrix display device, and more particularly to a liquid crystal, EL or ECD active matrix display device which uses a thin film transistor (TFT).

The active matrix display which uses the TFTs can offer a display device having a display unit and a peripheral drive circuits by TFT devices integrated on one substrate. This allows size reduction and cost reduction of the display device. The peripheral drive circuit was proposed in the Proceeding of IEEE, 59, 1566 (1971) and also proposed in JP-A-56-99396 and JP-A-57-201295.

Those circuits can drive display elements such as liquid crystal, EL and ECD by a smaller number of switching elements such as TFT's, and reduce the number of external connections, but still have rooms for improvement. Firstly, a signal voltage applied to a display element is held by a signal line capacitance C1 when a switching element such as TFT of the drive circuit is turned off, and applied to a switching element such as TFT of a picture element whose scan voltage of the display element has been selected. The voltage applied to a liquid crystal layer is determined by a capacitance proportion of the signal line capacitance C1 (if a capacity is created as required, it is paralelly added) and a capacitance $C1_c$ of the liquid crystal layer. Thus, the signal line capacitance C1 is selected to be sufficiently larger than the capacitance $C1_c$ of the liquid crystal layer. If a resistance $R_c$ between a signal electrode and a scan electrode which crosses thereto in a two-layer overcross structure is small, or if a resistance between a gate electrode of the switching element such as TFT and a drain electrode is small, the voltage held in the signal line capacitance C1 is discharged through the resistor and the voltage applied to the switching element such as TFT of the display unit is lowered. Such phenomenon takes place when any one of the switching elements such as TFT's or two-layer crossover connected to the signal line has an insufficient resistance. With such signal wiring, the voltage applied to the switching element such as TFT of the display unit is lowered. As a result, a display pattern of dark line is fixed and ununiformity in the display image takes place. In a worst case, a line defect takes place.

Secondly, input data is serially supplied from a video signal and the voltage applied to the display unit is driven by a point sequential scan operation or a time division sequential scan with a plurality of wires being in one block. As a result, there is a period in which no voltage is applied to the signal electrode, and there is a picture cell to which the voltage is applied for a short period. If a mutual conductance gm of the switching element such as TFT of the display unit is sufficiently high, the switching element such as TFT can fully charge the display element layer such as liquid crystal in a short period. However, if the mutual conductance gm is not high, the voltage is not applied to the display element layer such as liquid crystal for the picture cell whose voltage application period is short. As a result, ununiformity of display takes place or the number of scan lines of the display unit is limited by the limitation of the voltage application period.

The prior art device thus has problems in the drive characteristic of the display unit, the uniformity of the displayed image, the characteristic of the switching element such as TFT of the display unit and the need for formation of a high insulation film of a control electrode of the switching element such as TFT over the entire display area.

By using a line at-a-time scan circuit like a liquid crystal driving LSI, the above problems may be solved. However, since the circuits in the LSI require high speed transistor elements, the TFT element which uses the non-crystalline (for example, amorphous or polycrystalline) semiconductor film is not sufficient in its operation speed. Further, the LSI needs a complex circuit configuration and uses a number of transistor elements per stages. As a result, a yield of the circuit is low in a large size display.

SUMMARY OF THE INVENTION

It is an object of the present invention to provide a large-size matrix display device which uses switching elements which are hard to operate at a high speed such as TFT elements which use non-crystalline semiconductor thin film.

In order to achieve the above object, in accordance with one feature of the present invention, a matrix display device comprises:

a plurality of scan electrodes;

a plurality of signal electrodes;

a plurality of switching elements arranged one for each of crosspoints of said scan electrodes and said signal electrodes, each having one main terminal connected to the signal electrode, the other main terminal connected to the scan electrode and a control electrode connected to a display element;

a scanning drive circuit for supplying to said scan electrodes a scanning drive signal for sequentially selecting at least one of said scan electrodes;

a signal drive circuit including;

selection means for sequentially selecting at least one of display information signals corresponding to said signal electrodes when at least one of said scan electrodes is selected;

hold means for holding the display information signal selected by said selection means until the selection of at least corresponding scan electrode is completed; and voltage conversion means for selecting one of a plurality of voltage levels in accordance with the display information signal held by said hold means and supplying the selected voltage level to the signal electrode.

In accordance with a second feature of the present invention, a matrix display device comprises:

I ($\leqq 2$) scan electrodes;

J ($=M \times N$) signal electrodes divided into N ($\geqq 2$) groups each including M ($\geqq 2$) contiguously arranged ones;

$I \times J$ switching elements arranged one for each of crosspoints of said scan electrodes and said signal electrodes, each having one main terminal connected to the signal electrode, the other main terminal connected to the scan electrode and a control terminal connected to a display element;

a scanning drive circuit for supplying to the I scan electrodes a scanning drive signal for sequentially selecting at least one of the I scan electrodes;

a signal drive circuit including;

selection means for sequentially selecting, M times, N of display information signals corresponding to the J signal electrodes when at least one of the I scan electrodes is selected;

hold means for holding the display information signal selected by said selection means until the selection of at least corresponding scan electrode is completed; and voltage conversion means for selecting one of a plurality of voltage levels in accordance with the display information signal held by said hold means and supplying the selected voltage level to the signal electrodes.

Since the display information signal is held by the hold means until the selection of at least corresponding scan electrode is completed, one of the plurality of voltage level is always applied to the signal electrodes so that high impedance state of the switching elements is prevented. Accordingly, ununiformity in display is hard to occur and a large size matrix display device is easily attained.

Other objects and features of the present invention will be apparent from the description of the preferred embodiments.

DESCRIPTION OF THE PREFERRED EMBODIMENTS

Figure 1:
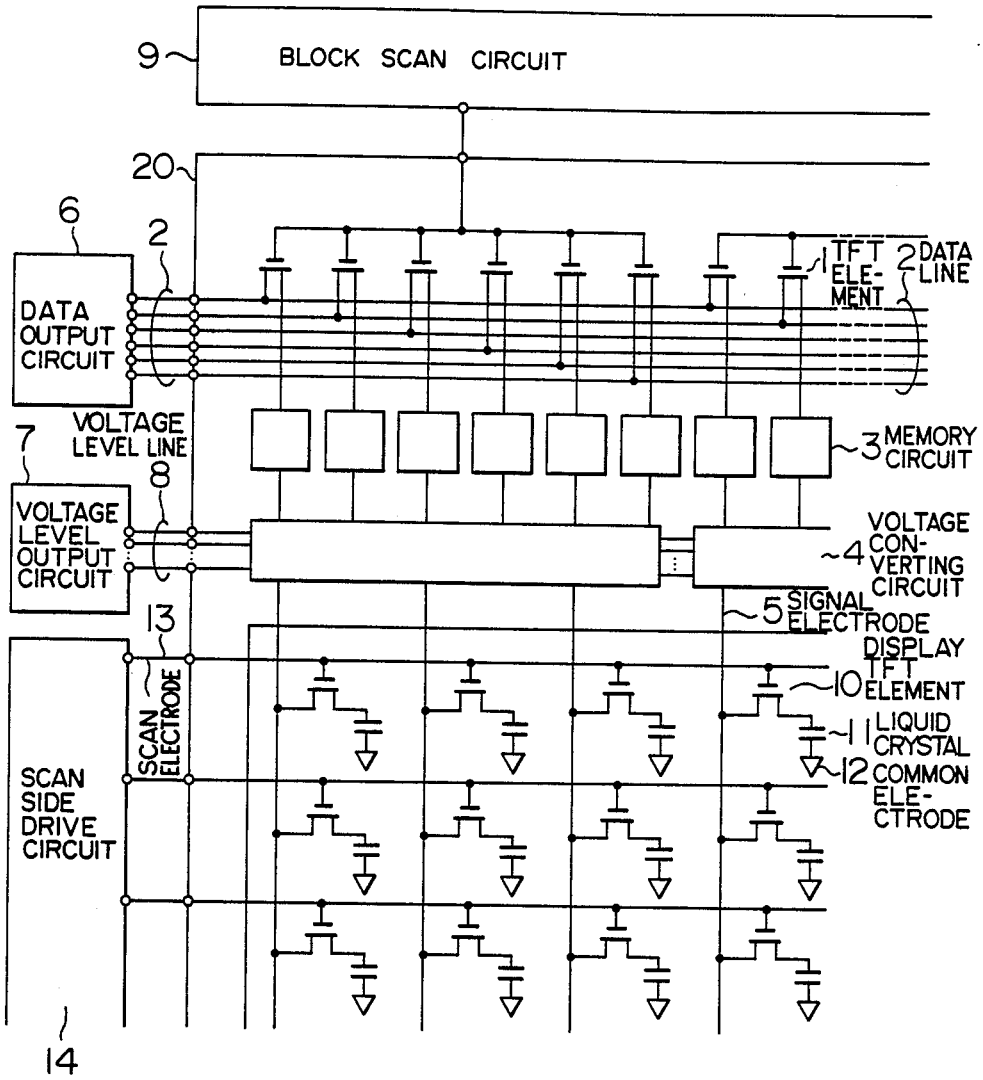
FIG. 1 shows an overall configuration of one embodiment of a matrix display device of the present invention, FIGS. 2, 3A and 3B and, 5, 6, 7 and 8 show circuit diagrams of the embodiment.

One embodiment of the presen invention is explained with reference to FIG. 1. The present embodiment mainly relates to the generation of a signal voltage pulse of the display. It is possible to generate a scanning voltage pulse by changing a timing of voltage generation and a voltage level. In FIG. 1, a display unit and a drive circuit are formed by TFT elements 10 which are switching elements on a transparent insulative substrate 20 such as glass or plastic film, a common electrode substrate 12 is arranged to face the substrate 20, and liquid crystal 11 which serves as display element is filled into a gap between the two substrates. As is known by an active matrix liquid crystal display, the display unit comprises a plurality of ($J \geqq 2$) signal electrode wires 5, a plurality of ($I \geqq 2$) scanning electrode wires 13 crossing thereto, and $I \times J$ TFT elements 10 arranged one for each of the crosspoints. A drain electrode D which is one main terminal of each TFT element 10 is connected to the signal wire 5, a gate electrode G which is a control electrode is connected to the scan electrode 13, and a source electrode S which is the other main terminal is connected to the transparent electrode which drives the liquid crystal which serves as display element. The TFT element 10 is explained by referencing an n-channel TFT element. A scanning drive circuit 14 supplies to the I scan electrodes 13 a scanning drive signal for sequentially selecting at least one of the I scan electrodes 13. It is arranged externally of the substrate 20, or it may be integrated in the substrate 20 by TFT elements.

In the present embodiment, a signal drive circuit for generating a voltage to be applied to the signal electrode 5 of the display unit connects the gate electrodes of the TFT elements 1 in common, sequentially connects the drain electrodes to data lines 2, connects the source electrode to a memory circuit 3 and supplies an output of the memory circuit 3 to a voltage conversion circuit 4. An output of the voltage conversion circuit 4 is supplied to the signal electrodes 5 of the display unit. The groups of TFT's whose gate electrodes are connected commonly are called blocks. A plurality of ($N \geqq 2$) blocks are provided in the signal drive circuit to drive a number of signal electrodes. The J signal electrodes 5 are divided into N ($\geqq 2$) groups each including M ($\geqq 2$) contiguously arranged ones. A digital informaiton signal is applied to the data line 2 from an off-chip (or it may be integrated in the substrate 20 by TFT elements) data signal generation circuit 6, and a voltage to sequentially select blocks is applied to the gate electrodes of N blocks from a block scan circuit 9 when at least one of the scan electrodes 13 is selected. The TFT elements which are turned on by the scan voltage transfer the data voltage applied substantially simultaneously with the scan voltage into the memory circuits 3. The TFT elements 1 and the block scan circuit 9 from the selection means.

While the data output circuit 6 and the block scan circuit 9 are arranged externally of the substrate 20, at least one of them may be integrated in the substrate 20 by TFT elements. The memory circuit 3 serves as hold means for holding data until selective scan period of one of horizontal scan lines 13 is completed or the next horizontal scan line is selected. The output of the memory circuit 3 continues while the memory circuit 3 holds data. One of a plurality of voltage levels applied by a voltage level line 8 from an external voltage level output circuit 7 (or it may be integrated in the substrate 20) based on the output of the memory circuit 3, and the signal drive voltage is applied to the signal electrode 5. The memory circuit 3 which serves as hold means may be a simple circuit comprising a single capacitor, a circuit comprising a number of TFT elements such as flip-flop circuits, or a circuit which utilizes an input capacitance of the TFT element. The voltage conversion circuit 4 has a function to select one of a number of voltage level lines based on the output data of the memory circuit 3. The number of inputs and the number of outputs of the circuit need not be equal, and the number of outputs changes with the tonality of the image to be displayed.

Figure 2:
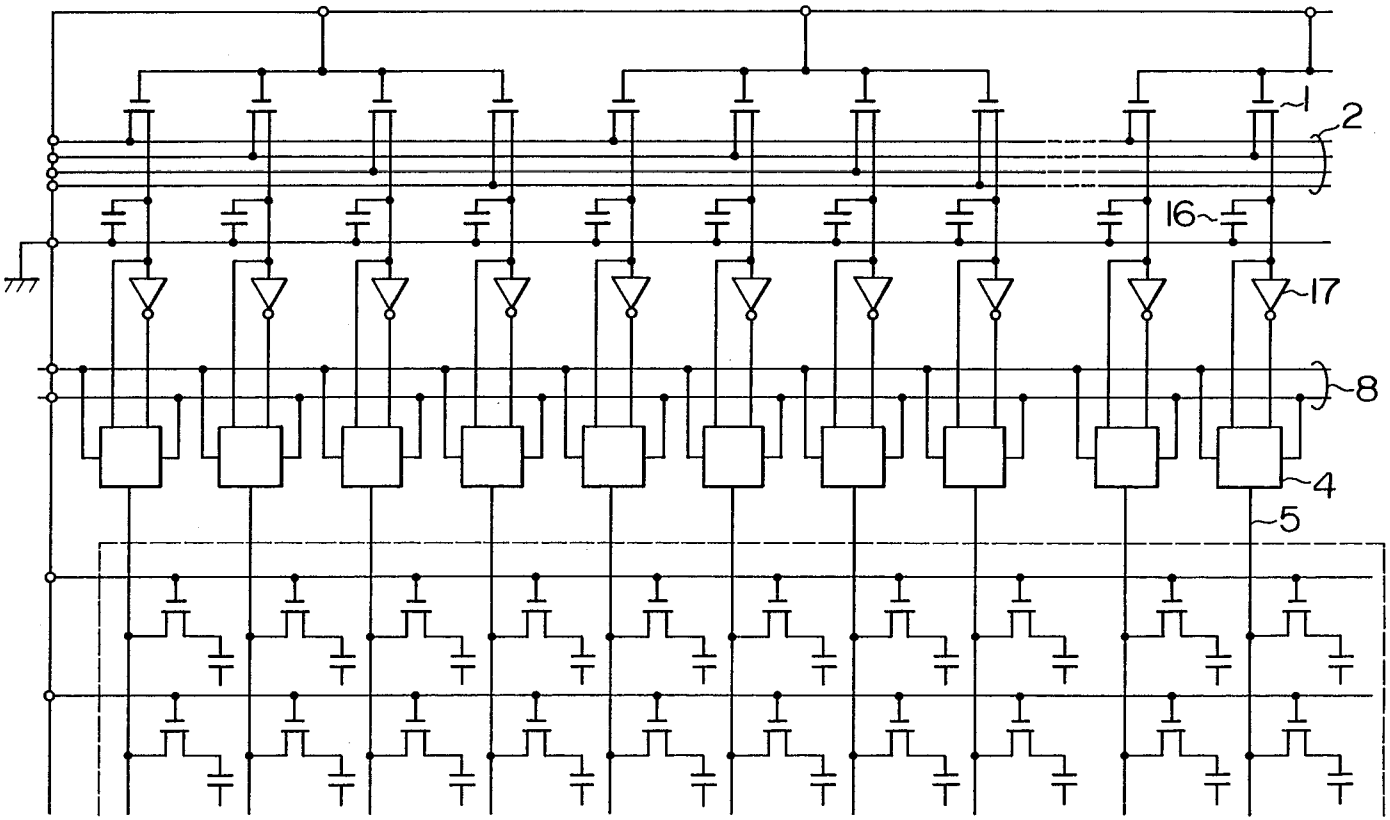

FIG. 2 shows a modification of the embodiment shown in FIG. 1. Capacitors 16 are formed as the memory circuit 3 and they are combined with the TFT elements 1 to hold data applied from the data line 2 through the TFT elements 1. In the present embodiment, the voltage stored in the capacitor is inverted by an inverter 17 so that the inverter 17 generates an output voltage which is of opposite phase to an input voltage. The output voltage is applied to a voltage conversion circuit 4. Two voltage levels 8 are supplied to the voltage conversion circuit 4. One of them is selected and it is applied to the signal wire 5 of the display unit. When an on/off binary image is to be displayed or a color image is to be displayed by using R, G, B color filters, the circuit of the present embodiment, is effective if the respective colors are changed in binary to make multi-color display.

Figure 3A:
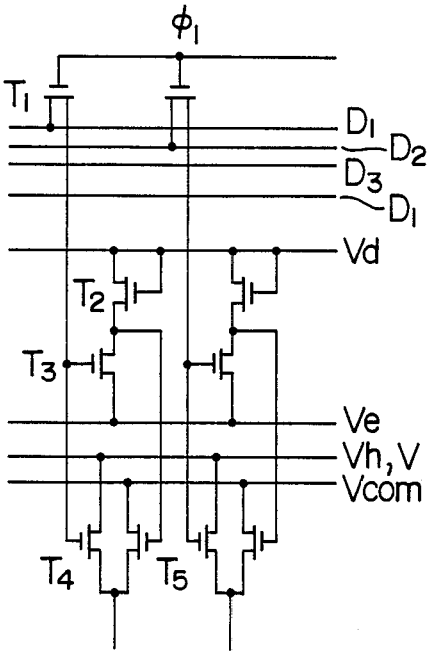
Figure 3B:
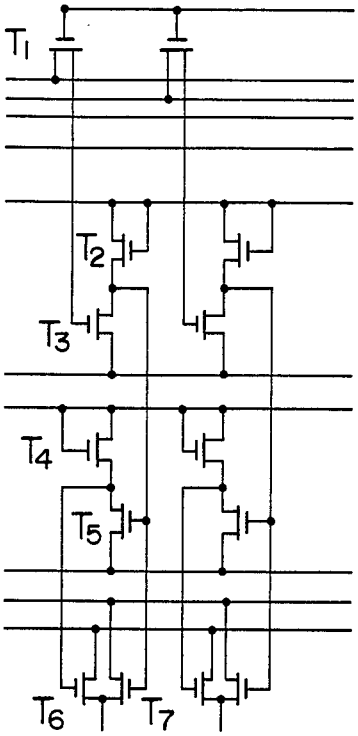

Specific circuits of the circuit shown in FIG. 2 are shown in FIGS. 3A and 3B. The circuit of FIG. 3A comprises a data read TFT element $T_1$, TFT elements $T_2$ and $T_3$ forming the inverter 17, and TFT elements $T_4$ and $T_5$ forming the voltage conversion circuit. It can drive one signal wire 5. The circuit of FIG. 3B comprises an inverter having TFT elements $T_2$ and $T_3$ as a buffer to amplify and convert voltage level of the output of $T_1$ in order to enhance a drive ability of TFT elements $T_4$–$T_7$.

In the circuits of FIGS. 3A and 3B, a data read section and a section to apply the voltage to the display unit may be separately designed. When the display unit is to be driven, the dimension of the TFT elements of the voltage conversion circuit 4 is designed in accordance with the area of the display unit and the load connected to one signal wire, on the number of TFT elements 1 in one block and the load of the memory circuit are designed in accordance with the data signal rate.

Figure 4:
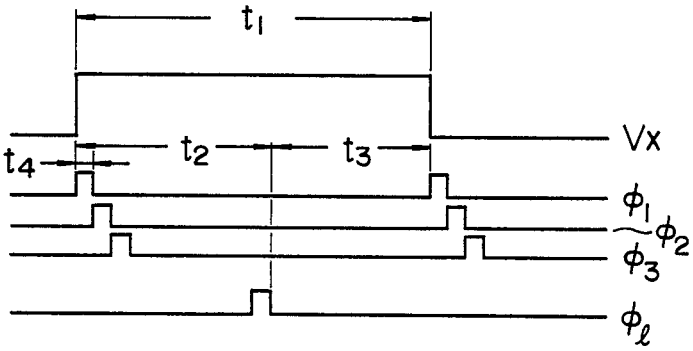
FIGS. 4 and 9 show timing charts of drive waveforms of the embodiment.

FIG. 4 shows a drive method for the embodiment described above. A selection time $t_1$ during which one of scan electrodes 13 of scanning drive voltage signal $V_x$ for sequentially selecting the horizontal scan electrodes 13 is divided into two time sections $t_2$ and $t_3$. In the time section $t_2$, the circuits connected to the vertical signal lines are scanned by block scan voltages $\phi_1$, $\phi_2$, . . . $\phi_l$ and signal data is read into the memory circuit through the TFT elements in the block. In the time section $t_3$, the voltage is applied from the voltage conversion circuit to the signal electrode by the output of the memory circuit so that voltages corresponding to the display image are written into the TFT elements of the display unit. In the time section $t_2$, not all outputs of the voltage conversion circuit 4 assume the high impedance state. Accordingly, an insulation resistance $R_c$ between the signal electrode 5 and the scan electrode 13 may be two order higher than an on-resistance $R_{on}$ of the TFT element 10. This is very advantageous in forming the display panel. Since a write time to the display unit for each signal electrode is longer than $t_3$, the voltage can be applied to the liquid crystal layer even if the on-resistance $R_{on}$ of the TFT element of the display unit is low. When a large size display device is to be formed, the number of horizontal scan lines increases and an address time to one scan line is shortened. Accordingly, the on-resistance $R_{on}$ of the TFT element of the display unit must be very low. In such a case, in accordance with the present embodiment, about half of the address time to one scan line may be used and hence the design of the TFT elements is facilitated.

By changing the time $t_4$ of the scan voltages $\phi_1$, $\phi_2$, . . . $\phi_l$ to the blocks the number of TFT elements in the block or the number of blocks, a ratio of $t_2$ and $t_3$ may be changed and $t_3$ may be selected in accordance with the characteristic of the TFT elements of the display unit.

Figure 5:
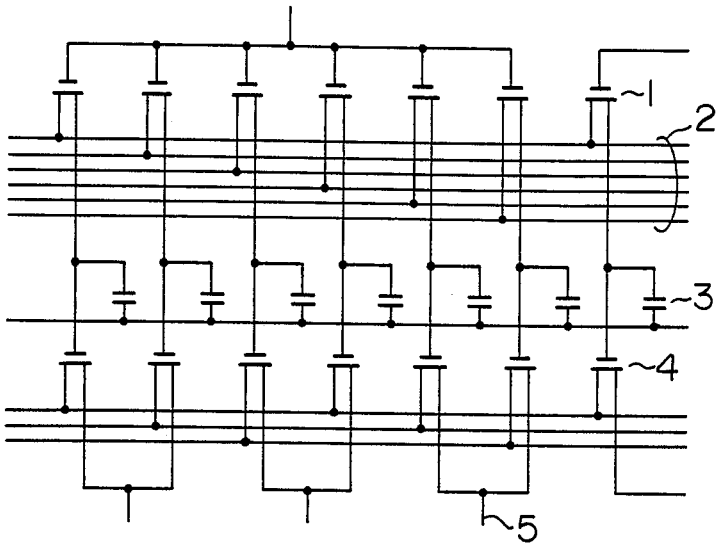

FIG. 5 shows a modification of the embodiment of FIG. 1. The outputs of the memory capacitors 3 are directly supplied to the voltage conversion circuits 4. Two data lines 2 and two TFT's are used to drive one signal electrode 5. The number of data lines is two times as large as that of the embodiment of FIG. 3, but the inverter circuits may be omitted and the circuit configuration is simplified.

Figure 6:
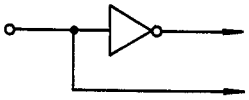

In the present embodiment, the voltages applied to the data lines must be paired, and in each pair, the data must be of inversive relation. This is attained by providing a CMOS circuit shown in FIG. 6 at the input of the data line 2.

Figure 7:
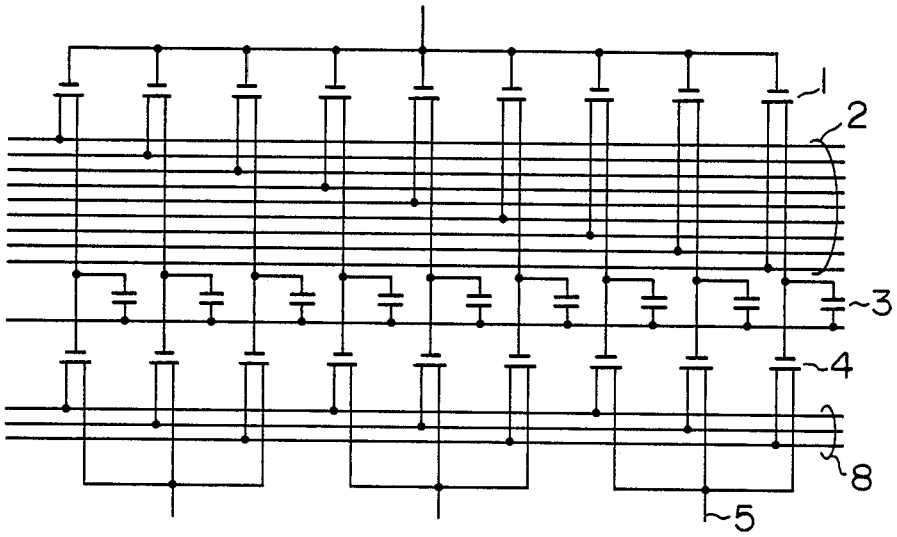

In the above embodiments, the display information of the display unit is on/off binary information. In FIG. 7, the present invention is applied to gray level display. Three TFT elements 1 in one block is grouped, the memory capacitor 3 serving as hold means and the voltage conversion TFT element are provided and one of three voltage levels on the voltage lines 8 is selected so that three-tone display is attached. In the present embodiment, the same timing operation as that of the previous embodiment may be attained and gray level display is attained with a very simple configuration. The embodiment of FIG. 7 displays three-tone image and multi-tone display may be attained in a similar manner.

The present invention is also applicable to a matrix display device of a conventional point sequential scan type instead of block division type.

Figure 8:
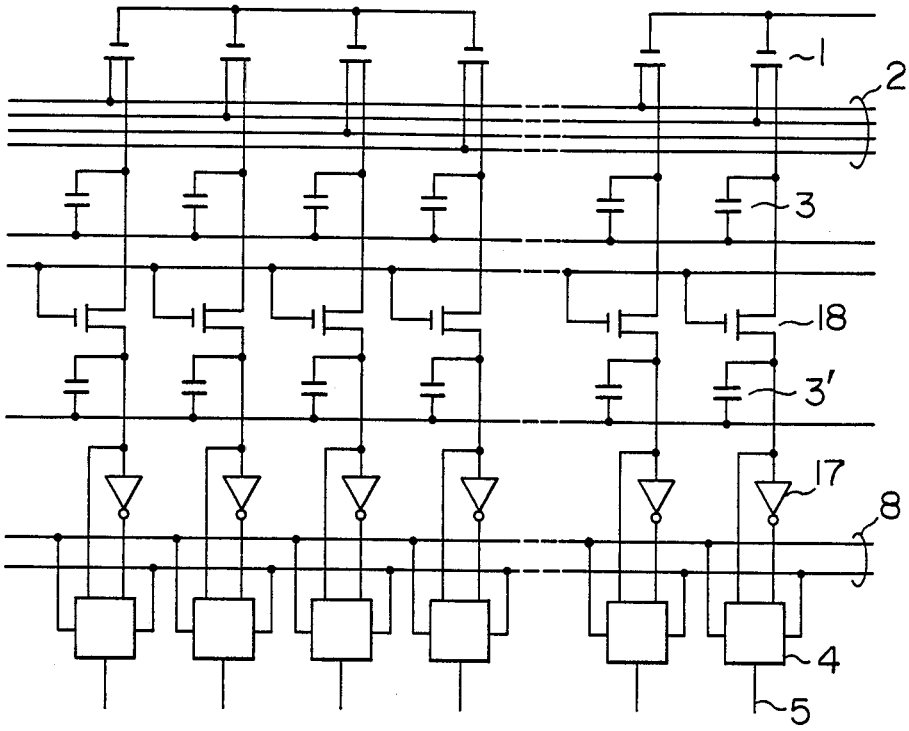
Figure 9:
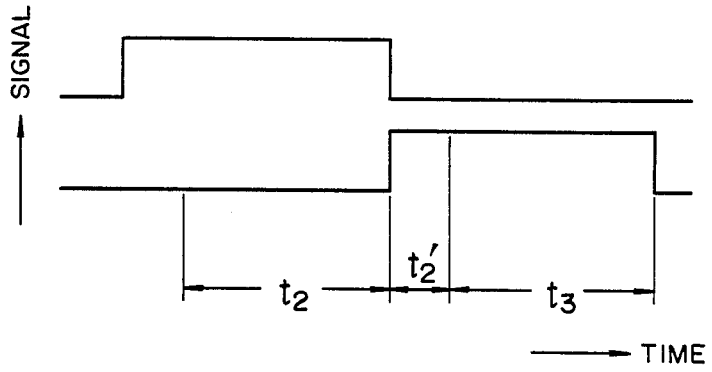

In FIG. 8, the memory circuits 3 are of twostage configuration and a transfer gate 18 is connected therebetween. The first stage memory circuit 3 reads data in a period $t_2$ which is one horizontal scan line prior to the display period, and when a voltage is applied to the horizontal scan line, the transfer gate 18 is turned on only for $t_2'$ to transfer the data of the memory circuit 3 to the memory circuit 3'. In a remaining period $t_3$, the voltage is applied to the display unit from the voltage conversion circuit.

In the present embodiment, the data input period $t_2$ and the voltage application period $t_3$ to the display unit can be sufficiently long.

In the above embodiments, the circuits are contained on the display panel substrate. However, the circuits of the present embodiment may be implemented by an LSI and connected externally of the display panel.

In accordance with the embodiments of the present invention, the TFT elements connected in matrix, memory circuit and voltage conversion circuit can be constructed by one or two TFT elements or one capacitor, respectively. Accordingly, the signal drive circuit is constructed with a small number of elements. Since the data read section and the voltage application section to the display unit are separately constructed, the characteristics of the TFT elements can be fully utilized and a high performance circuit is provided. Even if the insulation resistance of the two-layer wiring of the display unit and the insulation resistance of the gate electrode and drain electrode are low, the high quality display is attained. The on-characteristic of the TFT element of the display unit is equivalent to that of the conventional line sequential scan. Thus, the signal drive circuit of the embodiments can be readily constructed with the TFT elements without severe requirement of the characteristic to the display unit.

In accordance with the present invention, a large size matrix display device is provided by using switching elements which are hard to switch at high speed.

I claim:

1. A matrix display device comprising:

a plurality of scan electrodes;

a plurality of signal electrodes;

a plurality of switching elements arranged one for each of crosspoints of said scan electrodes and said signal electrodes, each having one main terminal connected to the signal electrode, the other main terminal connected to the scan electrode and a control electrode connected to a display element;

a scanning drive circuit for supplying to said scan electrodes a scanning drive signal for sequentially selecting at least one of said scan electrodes;

a signal drive circuit including;

selection means for sequentially selecting at least one of display information signals corresponding to said signal electrodes when at least one of said scan electrodes is selected;

hold means for holding the display information signal selected by said selection means until the selection of at least corresponding scan electrode is completed; and voltage conversion means for selecting one of a plurality of voltage levels in accordance with the display information signal held by said hold means and supplying the selected voltage level to the signal electrode.

2. A matrix display device comprising:

I (≧2) scan electrodes;

J (=M×N) signal electrodes divided into N (≧2) groups each including M (≧2) contiguously arranged ones;

I×J switching elements arranged one for each of crosspoints of said scan electrodes and said signal electrodes, each having one main terminal connected to the signal electrode, the other main terminal connected to the scan electrode and a control terminal connected to a display element;

a scanning drive circuit for supplying to the I scan electrodes a scanning drive signal for sequentially selecting at least one of the I scan electrodes;

a signal drive circuit including;

selection means for sequentially selecting, M times, N of display information signals corresponding to the J signal electrodes when at least one of the I scan electrodes is selected;

hold means for holding the display information signal selected by said selection means until the selection of at least corresponding scan electrode is completed; and voltage conversion means for selecting one of a plurality of voltage levels in accordance with the display information signal held by said hold means and supplying the selected voltage level to the signal electrodes.

* * * * *